US006135303A

United States Patent [19]

Schultz

[11] Patent Number: 6,135,303

[45] Date of Patent: Oct. 24, 2000

[54] UTILITY VESSEL WITH HOLDING MEANS BETWEEN THE VESSEL PORTION AND THE BASE ELEMENT

[75] Inventor: Horst Schultz, Hochheim, Germany

[73] Assignee: Synkrona AG, Switzerland

[21] Appl. No.: 08/765,959

[22] PCT Filed: Jul. 11, 1995

[86] PCT No.: PCT/DE95/00895

§ 371 Date: Mar. 5, 1997

§ 102(e) Date: Mar. 5, 1997

[87] PCT Pub. No.: WO96/01582

PCT Pub. Date: Jan. 25, 1996

[30] Foreign Application Priority Data

Jul. 12, 1994 [DE] Germany ..... 94 10 968 U

[51] Int. Cl.[7] ..... A47G 7/06; A47G 19/22

[52] U.S. Cl. ..... 215/377; 215/371; 220/630

[58] Field of Search ..... 215/371, 372, 215/377; 220/630

[56] References Cited

U.S. PATENT DOCUMENTS

| | | | |
|---|---|---|---|
| 782,710 | 2/1905 | Weller | 215/377 |
| 809,567 | 1/1906 | Henckel | 215/377 |
| 1,817,834 | 8/1931 | Orme | 220/630 X |
| 1,973,102 | 9/1934 | Reep . | |
| 2,099,635 | 11/1937 | Toniolo | 215/377 |
| 2,120,862 | 6/1938 | Heller | 215/377 |
| 2,664,004 | 12/1953 | Forman et al. | 215/377 |
| 2,997,199 | 8/1961 | Reachi | 220/630 X |
| 3,045,855 | 7/1962 | Lipman | 215/377 |
| 5,014,865 | 5/1991 | Sauber | 215/377 |

FOREIGN PATENT DOCUMENTS

| | | | |
|---|---|---|---|
| 1 400 358 | 5/1990 | European Pat. Off. . | |
| 400358 | 12/1990 | European Pat. Off. | 215/371 |
| 331981 | 10/1903 | France | 220/630 |
| 357416 | 12/1905 | France | 215/371 |
| 539384 | 6/1922 | France | 215/371 |
| 541774 | 8/1922 | France | 215/371 |
| 885381 | 9/1943 | France | 215/371 |
| 294810 | 10/1916 | Germany | 215/377 |

*Primary Examiner*—Sue A. Weaver

[57] ABSTRACT

In a utility vessel with a holding device which is arranged between a base element and a vessel portion and includes a projection which is arranged on the vessel portion and which at least partially narrows, and a receiving device for the projection, the receiving device being arranged on the base element, in order to simplify handling, to prevent unintentional damage on the part of the user and nonetheless to ensure a secure holding action as between the vessel portion and the base element, it is provided that the receiving device includes holding members which are guided displaceably inclinedly relative to the longitudinal axis of the receiving device and which, after introduction of the projection into the receiving device, engage over at least a part of the narrowing region of the projection.

13 Claims, 7 Drawing Sheets

UTILITY VESSEL WITH HOLDING MEANS BETWEEN THE VESSEL PORTION AND THE BASE ELEMENT

BACKGROUND OF THE INVENTION

1. Field of the Invention

The invention relates to a utility vessel with a holding means which is arranged between a base element and a vessel portion and more particularly to a utility vessel which includes a projection which is arranged on the vessel portion and which at least partially narrows, and a receiving means for the projection, the receiving means being arranged on the base element.

It is frequently desirable for utility vessels such as for example goblets or glass, porcelain or crystal drinking vessels or vases to be permanently or also releasably provided with a robust and durable base portion.

The combination of a metallic base portion and a fine glass, crystal or porcelain vessel permits the unspoilt consumption and enjoyment of high-quality fare, in particular drinks, while the vessel can be robustly handled by virtue of the strong stable base portion.

When there is a releasable connection between the base portion and the vessel portion, the operation of cleaning the utility vessel can be effected independently of each other and separately with the respectively necessary degree of care for each portion. In that case moreover the risk of damage due to the cleaning procedure, as for example in the case of long-stem glasses or in the case of sensitive porcelain goblets, is greatly reduced.

Even if damage should occur after a prolonged period of use, in principle, with a releasable connection between the base element and the vessel portion, it is possible for only the damaged part to be the subject of separate subsequent purchase.

Furthermore, in other areas involving vessels of plastic material or synthetic resin, for example in the sporting or camping sector, it is possible to manufacture combinations which are designed to save space, such as for example by virtue of using a base element and a vessel portion which can be fitted one into the other.

2. Discussion of Relevant Prior Art

For the foregoing reasons and for further reasons which are not set forth herein, there have already been many attempts to provide a utility vessel with a suitable holding means between the vessel portion and the base element.

U.S. Pat. No. 1,943,866 describes a vessel portion with a screw carried thereon, and a base element with a corresponding screwthread. The multiple rotary movement required for joining the two parts together can be tiresome and tilting of the screwthread, with subsequent damage, cannot be excluded.

U.S. Pat. No. 782,710 and British patent 424 509 show utility vessels with a conical projection on the vessel portion and crown cork-like, lateral, flexurally elastic grippers on the base element. In that case, the two parts are joined together by means of a force which urges the flexurally elastic grippers to the side and which, after passing beyond the maximum deflection thereof, allows them to engage over the conical projection. A disadvantage with that embodiment is that the necessary holding force which acts on the vessel portion requires a minimum force when the projection is inserted. The same flexurally elastic grippers must securely hold the vessel portion, on the one hand, while, contrary to that requirement, they must nonetheless permit easy insertion. It is precisely when using sensitive materials such as porcelain or crystal glass therefore that the utility vessel can suffer damage or be insecurely held.

French patent 539 384, in relation to a utility vessel, describes a bayonet-like configuration for the projection on the vessel portion and the receiving means of the base element. A disadvantage with that design is that the projection has to be fitted into the receiving means precisely and at the correct angle, for joining the two parts together. furthermore, that arrangement does not provide for coupling the base element and the vessel portion together in rigid angular relationship so that rotational movement of the vessel portion relative to the base element can result in the holding means being unintentionally released.

European Patent EP-A1-400 358 describes a holding means in the form of clamping jaws on a base element, which clamping jaws bear laterally against a cone part of the vessel portion and which can be tightened in the axial direction and which can then hold the cone part in a radially and axially stressed condition on the base element. Clamping chuck arrangements of that kind can produce extremely high forces and the operation of firmly tightening the clamping jaws can accidentally result in the projection being torn off the vessel portion.

U.S. Pat. No. 973,102 describes a projection which is fixed to the vessel portion and which is inserted into a receiving means arranged on the base portion so that a pin can engage perpendicularly through the receiving means behind an annular tapering region. A fixedly defined fit for the vessel portion cannot be guaranteed by means of a pin engaging behind the tapering region in that way.

SUBJECT OF THE INVENTION

Consequently the object of the present invention, in a utility vessel of the kind described, is to simplify handling thereof, to avoid accidental damage on the part of the user, and nonetheless ensuring a secure holding action as between the vessel portion and the base element.

In accordance with the invention that object is attained by a utility vessel with a holding device which is arranged between a base element and a vessel portion and which includes a projection which is arranged on the vessel portion and which at least partially narrows, and a receiving device for the projection, the receiving device being arranged on the base element. The receiving device includes holding members which are guided displaceably inclinedly relative to the longitudinal axis of the receiving device and which, after introduction of the projection into the receiving device, engage over at least a part of a narrowing region of the projection. The holding members are arranged in guide passages extending inclinedly relative to the longitudinal axis of the receiving device and are brought into a condition of abutment under the action of a force in a position of being closest to the longitudinal axis of the receiving device.

In the manner in accordance with the present invention, the expression 'guided displaceably inclinedly with respect to the longitudinal axis' denotes a guided movement with a displacement angle which is not parallel to the longitudinal axis of the receiving means. In that situation, displacement of the holding member or members is preferably in a straight direction or linearly. That however is not necessarily the case. The invention includes any, primarily inclinedly extending guided displacement movement, but not the flexural movements which involve elasticity of shape, as are known from the state of the art. Thus, the invention also includes displacement movements which are along curved paths, insofar as those paths are predetermined by a guided or positive movement.

The guided displacement movement can provide a holding effect with a retaining and/or with a self-locking action, as between the holding member on the one hand and the narrowing or tapering region of the projection on the other hand. The forces for introducing the projection can be kept at a low level, in that respect in principle low forces which under some circumstances only slightly exceed the force of gravity in respect of the holding members are already sufficient to introduce the projection and subsequently hold it securely in position. Nonetheless, because of the guided movement of the holding members, that can give rise to secure and high holding forces which are above the destruction limit of the projection. The actual embodiments according to the invention also have astonishingly positive handling properties; insertion of the projection into the holding means or device is effected easily and securely and in a very simple manner by simply fitting the two parts together. Depending on the actual design configuration adopted, latching can be effected in the arrested end or limit position with a clearly audible clicking noise which then informs the user that the parts have been satisfactorily fitted together.

Basically, insertion at the correct angle is not a necessity; the corresponding tapering configuration of the projection and/or the receiving means or device for the projection assist with insertion and guidance of the two parts relative to each other.

When the holding members are arranged, subjected to the action of a force, in the guide passages extending inclinedly relative to the longitudinal axis of the receiving means, and if the holding members thus come into a condition of abutment in a position of being closest to the longitudinal axis of the receiving means, automatic tolerance compensation occurs, whereby tolerances caused by the production procedure in respect of both the projection and also the receiving means are compensated. Even when a projection has only been partially introduced into the opening of the receiving means, tilting movements result in the projection being automatically further introduced with a stepwise movement, until it is in the condition of abutment. For example, in the case of a projection with a diameter of 10 mm, with a pairing of a glass projection and a metal holding member, it is easily possible to permit a tolerance range of at least ±0.3 mm.

If the differential angle between the angle of inclination of the narrowing or tapering region of the projection and the angle of inclination of the displacement movement of the holding members in the guide passages is less than 30°, then, while retaining automatic tolerance compensation, that affords less a retaining or detent action by virtue of one part engaging behind the other, but more a self-locking clamping action between the holding members in the guide passages on the one hand and the holding members and the tapering region of the projection on the other hand.

In the case of the glass-metal combination, a very good self-locking action occurs for a differential angle of about 5°. A way of applying forces to the holding members, which is advantageous in terms of production procedure and which is very robust, provides that cylindrical-symmetrical holding members project out of the guide passages in a lateral direction and have a pressure ring engaging there beneath under a force in the axial direction. A compression spring arranged between the pressure ring and a radial projection portion of the receiving means makes it possible to provide a very compact design configuration. In addition the compression spring is not subjected to any reduction in its force, even in the event of being repeatedly completely compressed extremely frequently.

A holding means which can be released in a simple fashion is provided by a slider which is arranged on the receiving means and which on the side opposite the pressure ring bears against laterally projecting parts of the holding members and which, upon displacement in the axial direction in opposite relationship to the effect of the force of the pressure ring, causes the holding members to move inclinedly back into the guide passages. With that construction, pushing the slider back causes release of the projection in the receiving means. In addition, the slider can be so designed that the interior of the receiving means is protected from dirt and damage. Making the external shape of the slider of a suitable configuration permits both aesthetically attractive and also ergonomic integration into the overall appearance of the vessel.

A means or device for preventing rotational movement of the slider can preferably comprise a longitudinal slot disposed in the axial direction on the inside of the slider and a pin which is held in a radial direction on the receiving means, the pin being engaged by the longitudinal groove. That can prevent unintentional rotational movement of the vessel when it is held by means of the slider.

If at least a part of the projection and the receiving means is of a non-round cross-section, that arrangement also prevents rotational movement of the vessel portion relative to the base element. In a further advantageous configuration the internal shape of the slider may be in the shape of a broached polygonal profile and the receiving means may have corresponding protrusions which project into the polygonal profile or the receiving means may also be in the shape of an external polygonal profile.

A plurality of holding means which are arranged between the base portion and the vessel portion for holding intermediate portions make it possible to produce vessels of different shapes, and they can be stored and/or transported in such a fashion as to save space.

A set of utility vessels may include one or more vessel portions, one or more base elements and one or more intermediate portions, which can be freely combined together using the holding means. By virtue of that arrangement, a large number of different utility vessels can be inexpensively assembled using just a few vessel portions and base elements. It is already possible to suitably take account of the most widely varying situations, with a range of just a few parts.

With a projection which is produced separately from the vessel portion, it is possible for any vessel portions to be integrated into the above-mentioned range, for example by being glued to the projection.

BRIEF DESCRIPTION OF THE DRAWINGS

The invention is described hereinafter in detail by means of specific embodiments with reference to the accompanying drawings in which.

DETAILED DESCRIPTION OF PREFERRED EMBODIMENTS

In the Figures, components which are the same or which are functionally identical, in various embodiments according to the invention, are respectively denoted by the same references.

Figure 1:
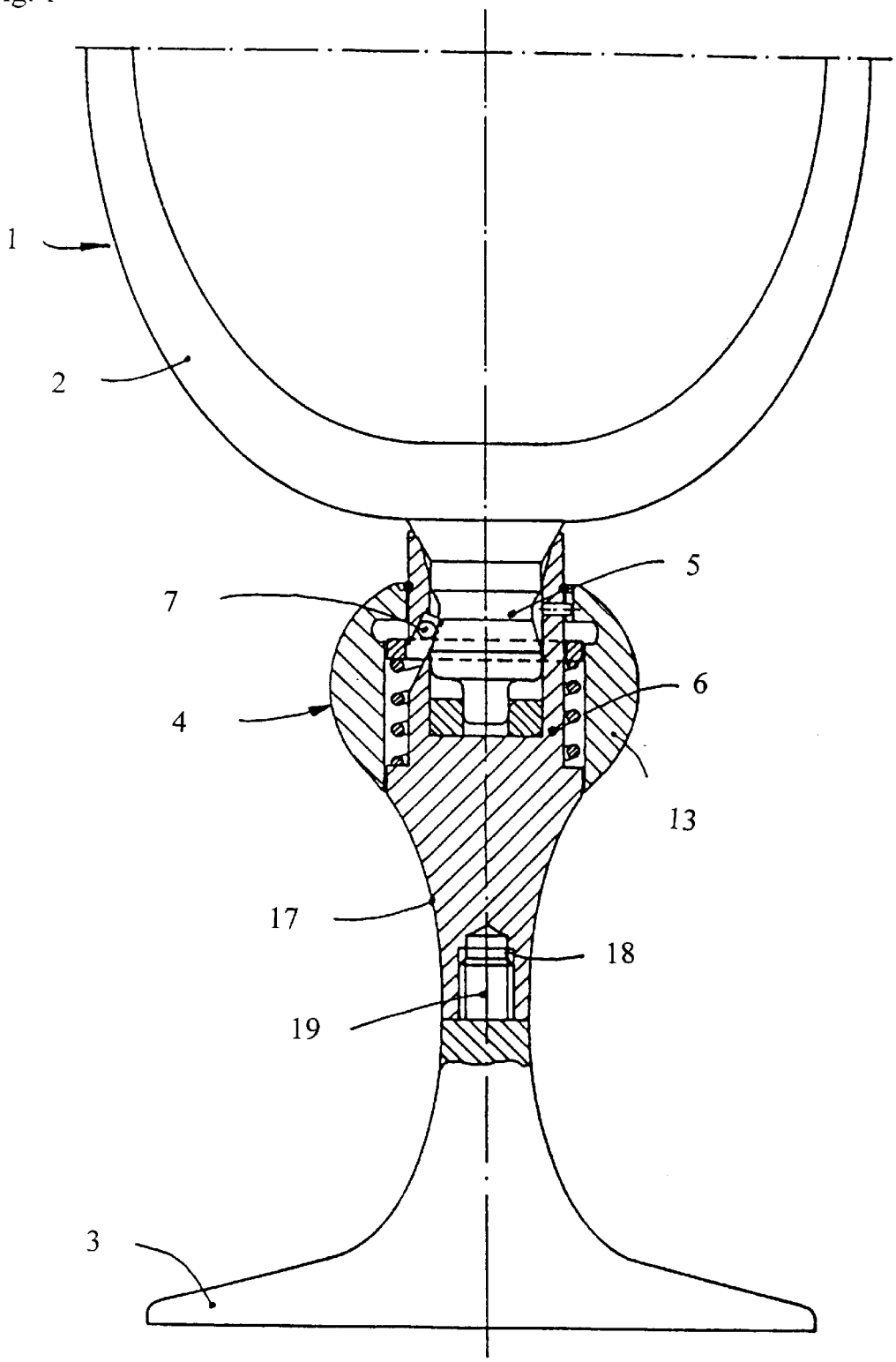
FIG. 1 is a side view of a utility vessel of a first embodiment according to the invention, partly in cross-section.
Figure 2:
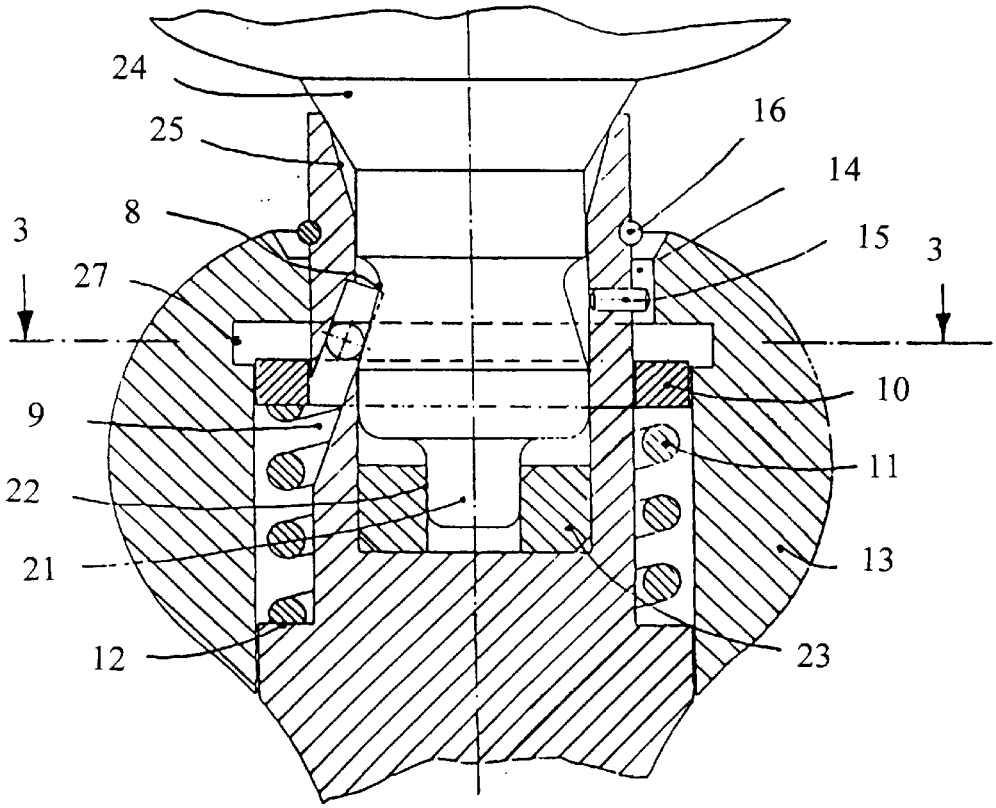
FIG. 2 shows a view on an enlarged scale in cross-section in the longitudinal direction of the holding means of the embodiment shown in FIG. 1.

Reference is now made to FIG. 1 showing a first embodiment, partly in cross-section. The utility vessel which is generally identified by reference 1 includes a vessel portion 2, a base element 3 and a holding means 4 arranged between the vessel portion 2 and the base element 3 for connecting them together.

In accordance with the invention the utility vessel can be a drinking vessel, an ornamental vessel, a vase, a candle holder or similar article for everyday use with a vessel portion. It is further in accordance with the invention, instead of the utility vessel, to hold another article of everyday use such as for example a statue, a piece of sculpture or plastic art, or a sacred object, in particular a cross. The base element 3 is a support base or is the lower part of a vase, a candle holder, a decorative or ornamental vessel with or without a handle portion, or forms the handle portion for a vessel portion 2.

The holding means 4 includes a projection 5 which is disposed on the vessel portion 2 and which at least partially narrows or tapers towards the vessel portion 2. A receiving means 6 can laterally embrace the projection 5 with a small amount of clearance and has holding members 7 which are guided in the receiving means 6 displaceably inclinedly relative to the longitudinal axis thereof.

After the projection 5 is introduced into the receiving means 6, the holding members 7 engage behind at least a part of a tapering region 8 of the projection 5. For that purpose the holding members 7 are arranged with lateral clearance in guide passages 9 which extend inclinedly relative to the longitudinal axis of the receiving means. In accordance with the invention, the expression 'guide passage extending relative to the longitudinal axis' denotes not only rectilinearly extending guide passages but also passages which extend in a curved configuration but whose main extent is not parallel to the longitudinal axis of the receiving means 6.

After the projection 5 has been introduced into the receiving means 6, the holding members 7 are moved preferably under the effect of a force in the guide passage 9 towards the longitudinal axis of the receiving means 6 so that they come into a position of abutment against the projection 5, in a position of being closest to the longitudinal axis. When the projection 5 is introduced that condition of abutment will generally occur at the tapering region 8. When the holding means 4 is used in the inverted position relative to the views in the Figures, no further auxiliary means are required to move the holding members 7 into the desired positions. The force of gravity is already sufficient for that purpose. When the holding means 4 is used in the manner shown in the Figures, means are provided for applying a force to the holding elements 7.

Figure 3:
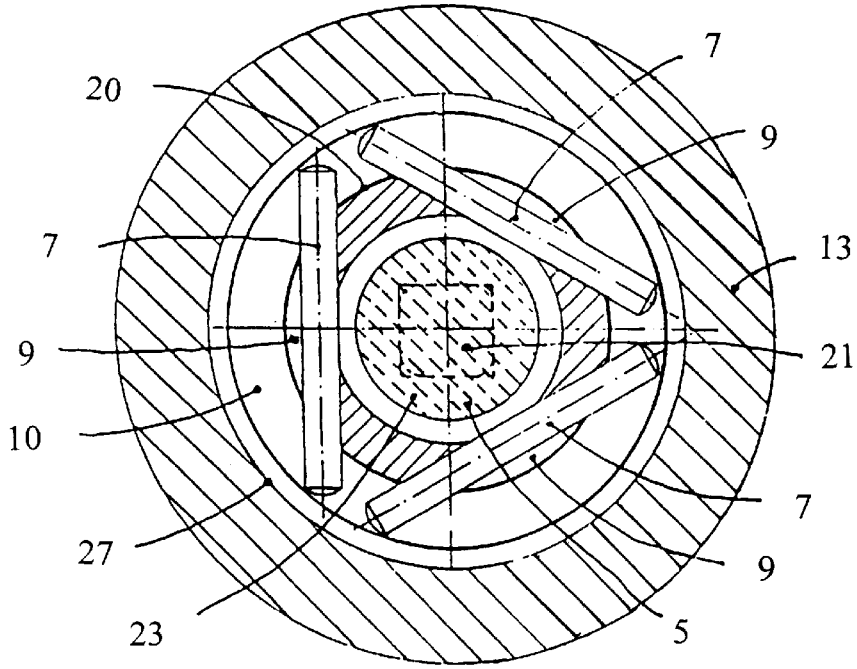
FIG. 3 is a view in cross-section through the holding means shown in FIG. 2 taken along line 3—3 in the horizontal direction.

The axially symmetrical holding members 7 which in the present embodiments can be pins or cylinders project laterally beyond the guide passages 9, as can be seen for example from FIG. 3. A pressure ring 10 is held axially displaceably on the receiving means 6 in such a way that at least some of the laterally projecting holding members 7 are force-lockingly engaged by the pressure ring. Disposed beneath the pressure ring 10 is a cylindrical compression spring 11 which, on the side remote from the pressure ring 10, bears against a radial enlargement or shoulder 12 of the receiving means 6. By means of the pressure ring 10, the compression spring 11 applies an upwardly directed force to the holding members 7; by virtue of the inclinedly extending guide passages 9, the upwardly directed force causes the holding elements 7 to bear against the tapering region 8 of the projection 5, in the manner already described above.

Figure 5:
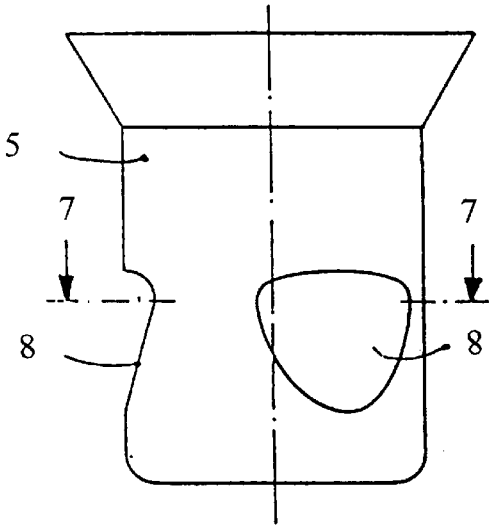
Figure 6:
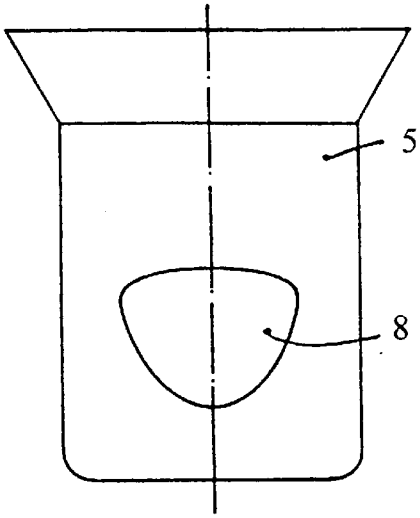
Figure 7:
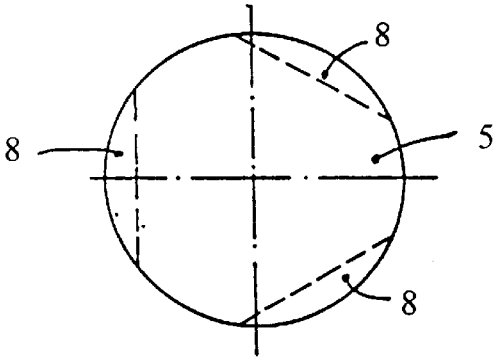
FIG. 7 is a view in cross-section through the projection from FIG. 5, taken along line 7—7.

If the projection 5 has the tapering regions 8 which are shown in FIGS. 5 and 6 and which are associated with respective design configurations having three or two holding members 7, the projection 5 can cause the holding elements 7 to move back by virtue of rotational movement of the vessel portion 2 relative to the base element 3 if the angle of the guide passages 9 is suitably selected, and in that way the vessel portion 2 can be released from the base portion 3. The angle of the guide passage 9, which is used in this embodiment, prevents tilting movement of the holding elements 7 when the projection 5 is rotated relative to the receiving means 6.

In an alternative embodiment the tapering region 8 or the tapering regions 8, in accordance with the various embodiments, are provided with the illustrated angles of 20°, in which case, when the vessel portion 2 is rotated relative to the base element 3, that arrangement provides a self-locking action and thus the tapering regions 8 shown in FIGS. 5 and 6 serve as rotation-preventing means for preventing the vessel portion 2 from rotating relative to the base element 3.

This embodiment, to provide a releasable holding means 4, has a slider 13 which can cause the holding members 7 to move back laterally. On the side opposite to the pressure ring 10 the slider 13 bears against regions of the holding members 7, which regions project laterally out of the guide passages 9, and the slider engages in the axial direction over both the pressure ring 10 and also the compression spring 11 and the lateral enlargement 12. Upon axial displacement of the pressure ring 10 against the force of the compression spring 11, the holding members 7 are pushed back laterally outwardly in the guide passages 9 so that in that way the force-locking contact against the tapering region or regions 8 is initially interrupted and consequently the internal width of the opening 20 of the receiving means 6 is cleared and the projection 5 with the vessel portion 2 can be removed from the receiving means 6.

In order to permit the holding members 7 to move back laterally, the slider 13, in its upper region, has a suitable radial enlargement 27.

A longitudinal slot it is disposed, extending in the axial direction, on the inside of the slider 13, as a rotation preventing means. A pin 15 is held on the receiving means 6, the front part of the pin 15 projecting into the longitudinal slot 14.

Figure 8:
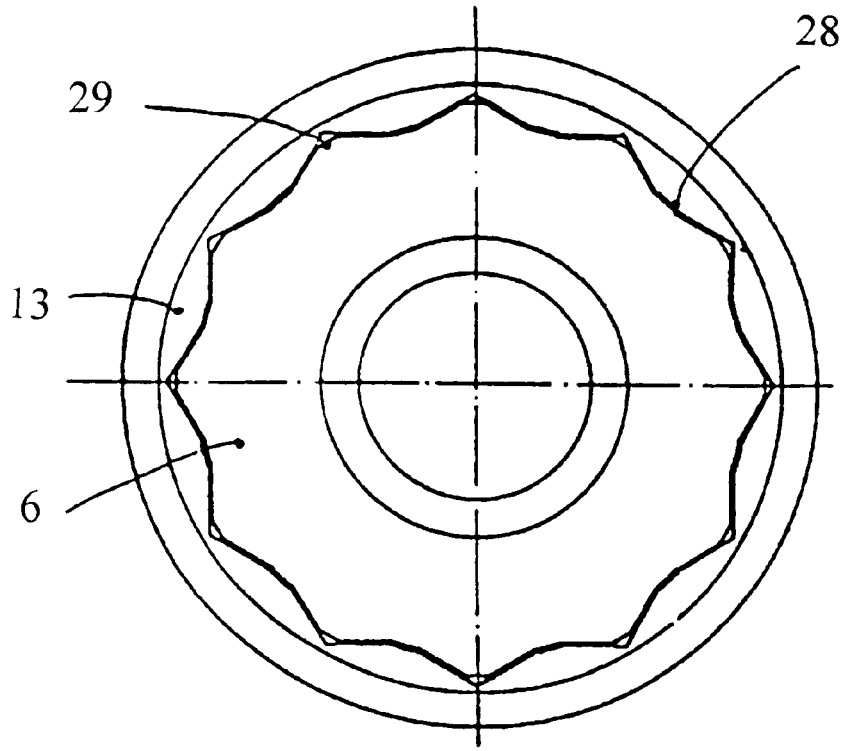
FIG. 8 is a view in cross-section through the holding means of a further embodiment according to the invention, taken along line 8—8 in FIG. 12.
Figure 9:
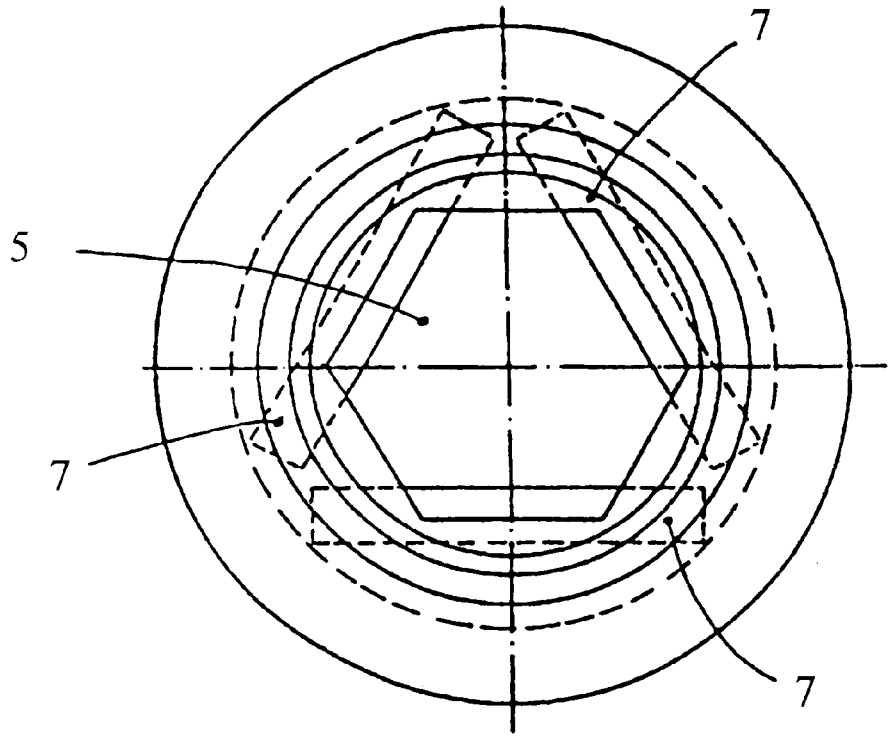
FIG. 9 is a view in cross-section through the holding means of the further embodiment according to the invention, taken along line 9—9 in FIG. 12.
Figure 10:
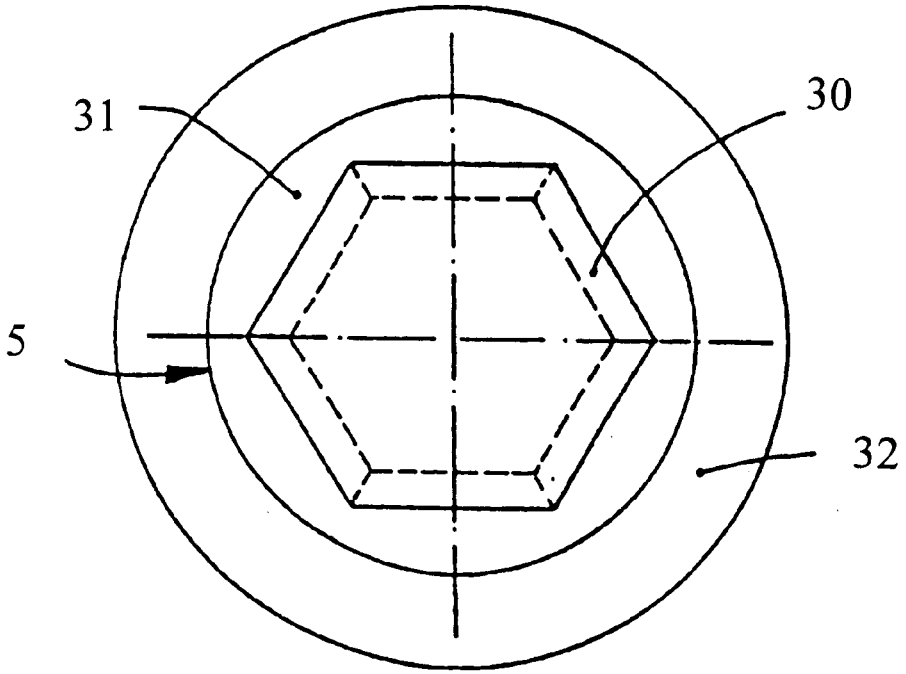
FIG. 10 is a plan view of a projection with an hexagonal profile.
Figure 11:
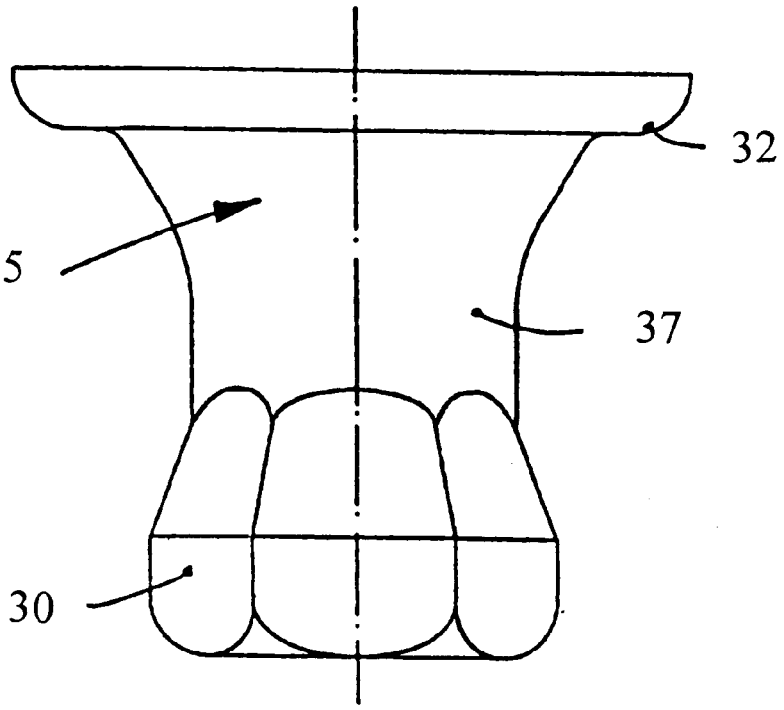
FIG. 11 shows a side view of a projection provided with an external hexagon.
Figure 12:
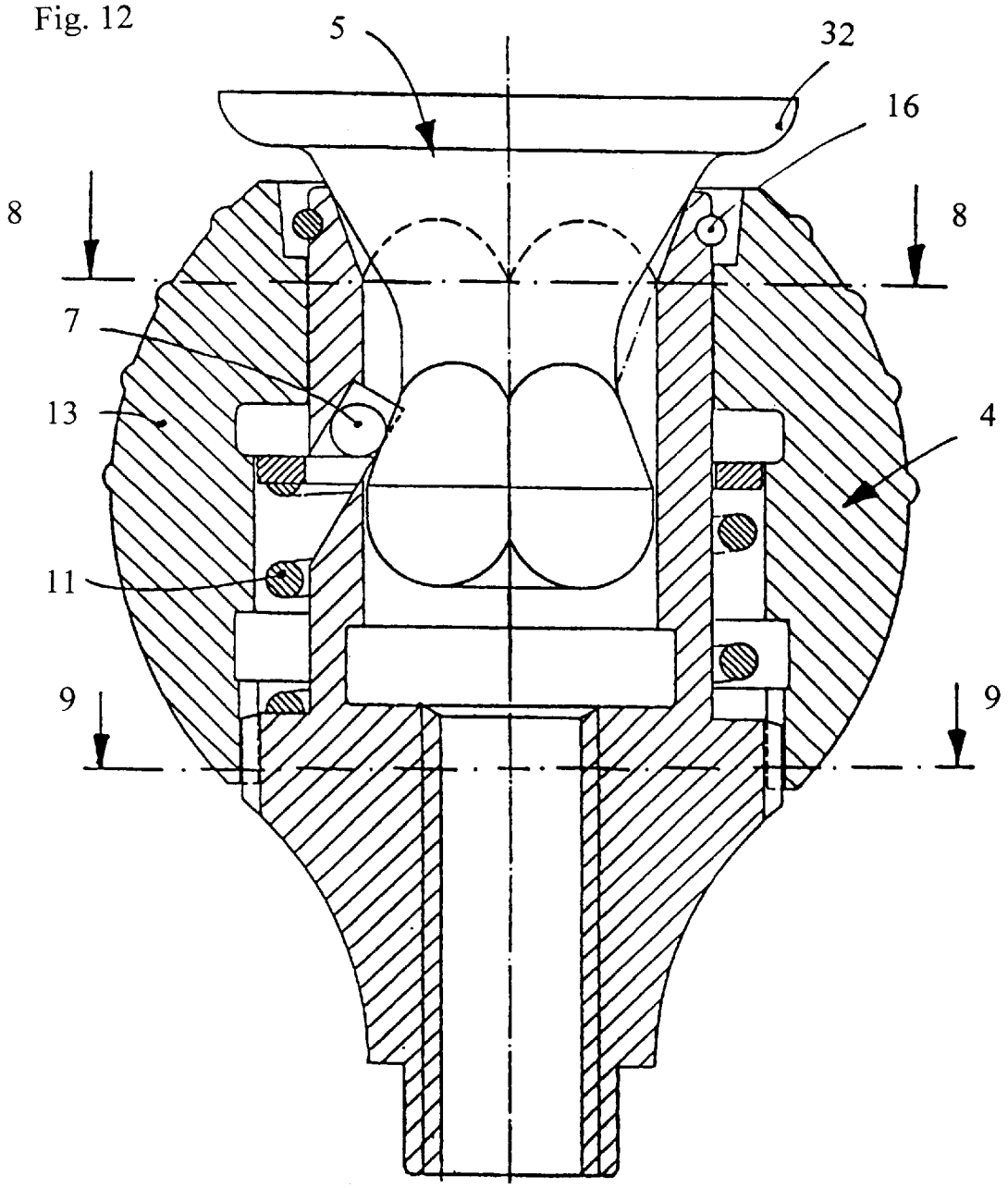
FIG. 12 is a view in cross-section in the longitudinal direction through the further embodiment according to the invention, in approximately the plane of the center line thereof, but without a vessel portion fixed to the projection.

In a further configuration according to the invention, the slider 13 forms a preferably broached internal polygonal profile 28 which is shown in FIG. 8 and which, with a slight amount of lateral clearance, embraces the external hexagonal profile 29 of the receiving means 6.

The axial movement of the slider 13 is limited towards the vessel portion 2 by a ring 16 which is held in a depression provided laterally on the receiving means 6.

In a further configuration according to the invention, the slider 13 not only protects the interior of the receiving means 6 from fouling by dirt, but in addition is also in the form of a decorative element, the external configuration of which organically matches the gripping portion 17 of the base element 3.

In the embodiment shown in FIG. 1, the gripping portion 17 of the base element 3 is of a two-part nature and on one part thereof has a screw threaded bore 18 and on the other part thereof has a screw 13 or a screw threaded pin 19 for producing a mechanical connection. Alternatively that connection is afforded by a further holding means 4.

Depending on the respective utility vessel involved, it is possible to use a plurality of holding means 4 in order to hold any intermediate portions (not shown) which are disposed between the base element 3 and the vessel portion 2.

A set of utility vessels, which preferably includes identical external configurational features in regard to the design or the external shape and color may have different vessel portions 2 in the form of drinking vessels for wines, beers, other alcoholic drinks or non-alcoholic beverages, and respectively matching intermediate portions and base elements 3 of different sizes and lengths.

If, in the case of a vessel 1 in the form of a candle holder, the vessel portion 2 serves to receive candles, multiarm intermediate portions can permit the flexible construction of different kinds of candle holders.

In order to provide a rotation-preventing configuration in utility vessels of that kind and with cylindrical-symmetrical embodiments of the tapering region 8 of the projection 5, at least a part of the projection 5 and the receiving means 6 may be of a non-round cross-section. In that case, either the entire projection 5 and the entire opening 20 of the receiving means 6 or respectively mutually associated regions may be non-round. Preferred non-round shapes include shapes that are oval, elliptical, polygonal or of a rounded-polygonal configuration. Particularly preferred embodiments include the triangular and hexagonal or diagonal configurations of the projection 5 and the respectively associated opening 20 of the receiving means 6, as shown in FIGS. 9 through 12. As in that respect there are generally at least three force-locking connecting points within the holding means 4 between the projection 5 and the receiving means 6, a tilting action as between the vessel portion 2 and the base portion 3 is always prevented.

The hexagonal profile 30 of the projection 5 preferably blends into a circular profile 32, in the upper region. Depending on the respective configuration of the opening 20, the projection 5 may have a round or hexagonal transitional region 31 which is respectively preferably positively locking in relation to the upper edge of the opening 20.

In an alternative embodiment according to the invention a projection 5 of a round configuration has a downwardly projecting, non-round portion 21 which projects into a corresponding non-round opening 22 in the receiving means 6. The opening 22 is provided either directly at the bottom of the opening 20 or it is disposed in a ring 23 which is fitted into the opening 20 and fixed therein.

Above the tapering region 8 the projection 5 has a column-shaped section which is enlarged towards the vessel portion 2 radially, or, in the case of cylindrical-symmetrical embodiments, in a frustoconical shape. When the projection 5 is introduced the radially enlarging region 24 is guided by the funnel-shaped exit portion 25 of the receiving means 6, and contact occurs between the projection 5 and the receiving means 6 in an annular region 26.

The self-centering action of the co-operation of the radially enlarging region 24 with the funnel-shaped exit 25 is assisted by suitable angles of inclination of the tapering region 8 and the guide passages 9.

Figure 4:
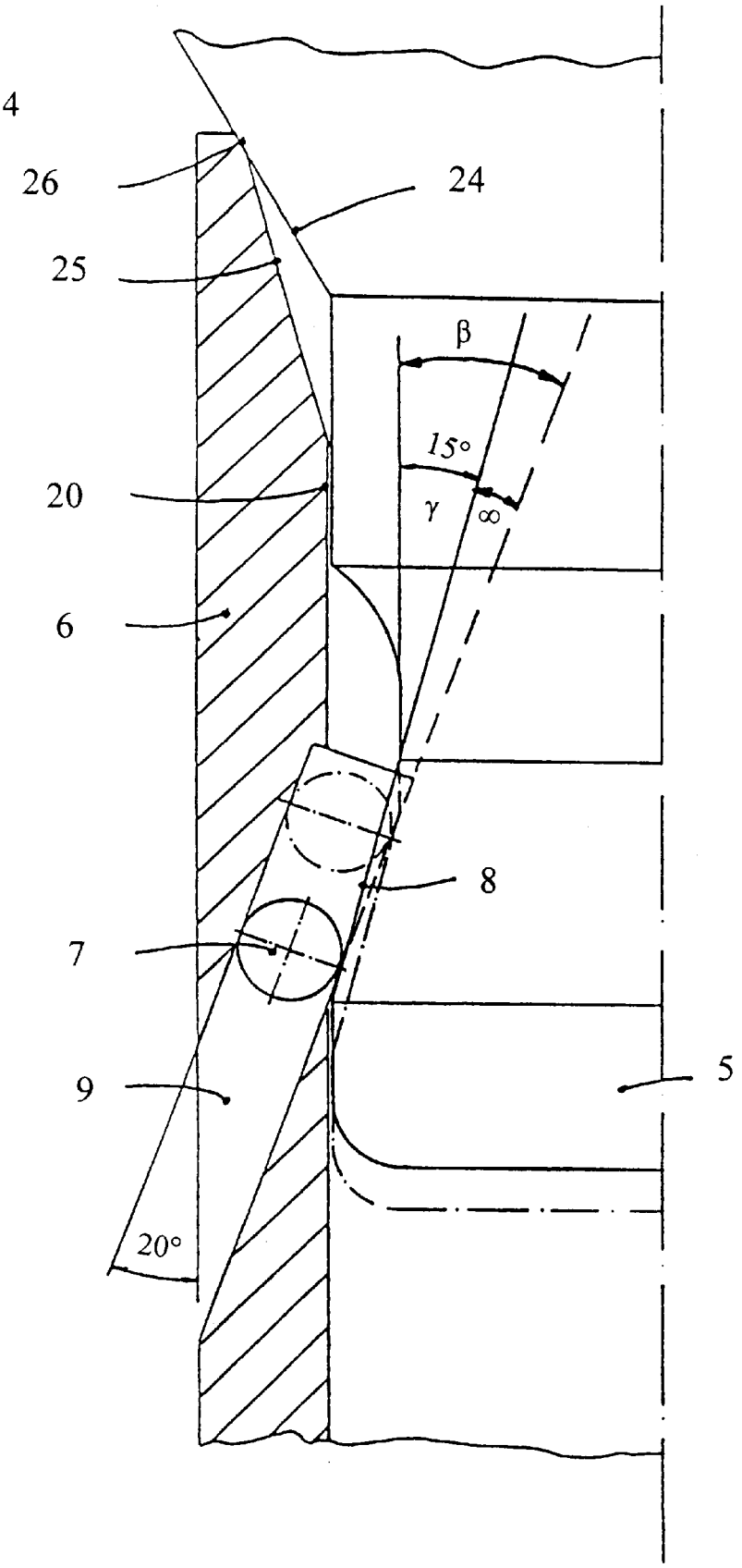
FIG. 4 is a diagrammatic view on an enlarged scale of the receiving means and the projection shown in FIG. 2, FIGS. 5 and 6 are diagrammatic side views of projections of utility vessels according to the invention.

A self-locking action in respect of the holding means 4 is achieved if the differential angle, as indicated by $\alpha$ in FIG. 4, between the inclination $\beta$ of the guide passages and the inclination $\gamma$ of the tapering region, in each case relative to the longitudinal axis of the receiving means 6, is less than 30°. An advantageous differential angle $\alpha$ with a high self-locking action is 5°. In that respect preferably the angle $\beta$ of the inclination of the guide passage 9 relative to the longitudinal axis of the receiving means 6 is 20° and the inclination of the tapering region 8 relative to the longitudinal axis of the receiving means 6 is 15°. This angle arrangement which is excellently well suited for a pairing of materials consisting of steel holding elements 7 with a glass projection 5 can however be modified when using other materials, in order to optimize the self-locking action.

Suitable materials for the vessel portion 2 are glass, porcelain or ceramic material which can be easily used with metal holding members 7. In addition it is also possible to use base elements 3 of glass or consisting of porcelain, ceramic or plastic material. With a suitable selection in respect of the above-described angles of inclination $\alpha$, $\beta$, $\gamma$, those materials can also generally be used for the holding means 4, in particular the holding members 7.

In order to be able to use any vessel portion materials and/or to adopt procedures which are advantageous from the point of view of the production process, the projection 5 can be manufactured independently of the vessel portion 2 and subsequently joined thereto, for example by adhesive.

In this case the material of the projection 5 can be selected independently of the vessel portion 2. In addition, as an individual component, the projection 5 becomes an item which can be independently handled and which can also be mounted by the purchaser to vessel portions 2 from other manufacturers or virtually any vessels of the purchaser's own choice.

What is claimed is:

1. A utility vessel with a holding device which is arranged between a base element and a vessel portion and which includes a projection which is arranged on the vessel portion and which at least partially narrows, and a receiving device for the projection, the receiving device being arranged on the base element, characterised in that the receiving device (6) includes holding members (7) which are guided displaceably inclinedly relative to the longitudinal axis of the receiving device and which, after introduction of projection (5) into the receiving device (6), engage over at least a part of a narrowing region (8) of the projection (5), wherein the holding members (7) are arranged in guide passages (9) extending inclinedly relative to the longitudinal axis of the receiving device (6) and are brought into a condition of abutment under the action of a force in a position of being closest to the longitudinal axis of the receiving device (6).

2. A utility vessel as set forth in claim 1 characterised in that a differential angle ($\alpha$) between an angle of inclination ($\beta$) of the narrowing region (8) and an angle of inclination ($\gamma$) of the displacement movement of the holding members (7) in the guide passages (9) is less than 30°.

3. A utility vessel as set forth in claim 2 characterised in that the differential angle ($\alpha$) between the angle of inclination ($\beta$) of the narrowing region (8) and the angle of inclination ($\gamma$) of the displacement movement of the holding members (7) in the guide passages (9) is 5°.

4. A utility vessel as set forth in claim 1 characterised in that the holding members (7) are cylindrical-symmetrical and project in a lateral direction out of the guide passages (9), wherein a pressure ring (10) bears displaceably in the axial direction of the receiving device (6) and under the action of a force against projecting parts of the holding members (7).

5. A utility vessel as set forth in claim 4 characterised in that the receiving device (6) includes a slider (13) which, on the side opposite the pressure ring (10), bears against laterally projecting parts of the holding members (7) and upon displacement in the axial direction against the effect of the force of the pressure ring (10), causes the holding members (7) to move inclinedly back in the guide passages (9).

6. A utility vessel as set forth in claim 5 characterised in that the slider (13) has a rotation-preventing device comprising a longitudinal slot (14) provided in the axial direction on the inside of the slider (13) and a pin (15) held in the radial direction on the receiving device (6), wherein the pin (15) is engaged by the longitudinal slot (14).

7. A utility vessel as set forth in claim 1 characterised in that at least a part of the projection (5) and the receiving device (6) are of a non-round cross-section perpendicularly to their longitudinal extent.

8. A utility vessel as set forth in claim 7 characterised in that the non-round part of the projection (5) and the receiving device respectively is of an oval, elliptical, polygonal or rounded-polygonal configuration.

9. A utility vessel as set forth in claim 1 characterised in that the lower part of the projection (5) or a downwardly projecting part of the projection (5) is non-round and an opening (22) at the bottom of the opening (20) of the receiving device (6) is correspondingly non-round and can positively lockingly embrace the lower part (21) of the projection (5) or the downwardly projecting part (21) of the projection (5).

10. A utility vessel as set forth in claim 1 characterised in that the projection (5) narrows in a number of regions (8), corresponding to the number of holding members (7) of the receiving device (6).

11. A utility vessel as set forth in claim 1 characterised in that at least one of the vessel portion (2), the holding device (4) and the base element (3) is selected from the group consisting of glass, porcelain, crystal glass, ceramic, plastic material and metal.

12. A utility vessel as set forth in claim 1 characterised in that a plurality of holding devices (4) are arranged between the base element (3) and the vessel portion (2) for holding intermediate portions.

13. A set of utility vessels as set forth in claim 1 including at least one vessel portion (2), at least one base element (3) and at least one intermediate portion, which can be connected together using holding devices (4).

* * * * *